US012342911B1

(12) United States Patent
Kaplan

(10) Patent No.: US 12,342,911 B1
(45) Date of Patent: Jul. 1, 2025

(54) RING WITH COMFORT FIT INTERIOR

(71) Applicant: Crown Ring Inc., Saint-Laurent (CA)

(72) Inventor: Gagi Kaplan, Hollywood, FL (US)

(73) Assignee: CROWN RING INC., Montreal (CA)

( * ) Notice: Subject to any disclaimer, the term of this patent is extended or adjusted under 35 U.S.C. 154(b) by 0 days.

(21) Appl. No.: 18/235,470

(22) Filed: Aug. 18, 2023

(51) Int. Cl.
*A44C 9/00* (2006.01)

(52) U.S. Cl.
CPC ..... *A44C 9/0053* (2013.01)

(58) Field of Classification Search
CPC ..... A44C 9/00
See application file for complete search history.

(56) References Cited

U.S. PATENT DOCUMENTS

| | | | |
|---|---|---|---|
| 46,735 | A | 3/1865 | Thomson |
| 138,314 | A | 4/1873 | Bruhl |
| 201,378 | A | 3/1878 | Allen |
| 434,693 | A | 8/1890 | Woodbury |
| 625,959 | A | 5/1899 | Saart |
| 766,124 | A | 7/1904 | Ochoa |
| D39,049 | S | 2/1908 | Scullin |
| D46,735 | S | 12/1914 | Heller |
| D47,722 | S | 8/1915 | Heller |
| D48,644 | S | 2/1916 | Miller |
| 1,252,966 | A | 1/1918 | Suderov |
| 1,293,028 | A | 2/1919 | Campbell |
| 1,422,819 | A | 7/1922 | Blaicher |
| 1,448,465 | A | 3/1923 | Sherman |
| 1,553,198 | A | 9/1925 | Stern |
| D68,641 | S | 11/1925 | Robbins |

(Continued)

FOREIGN PATENT DOCUMENTS

| | | |
|---|---|---|
| AR | 046897 | 6/2013 |
| CA | 2568906 | 7/2002 |

(Continued)

OTHER PUBLICATIONS

Etsy, Layering Necklace Tube Necklace Dainty Silver Tube Pendant, pp. 1-5, https://www.etsy.com/listing/1086481823/layering-necklace-tube-necklace-dainty?ga_order=most_relevant&ga_search_type=all&ga_view_type=galle%E2%80%A6, Jan. 1, 2021.

(Continued)

*Primary Examiner* — Jack W Lavinder
(74) *Attorney, Agent, or Firm* — Malloy & Malloy, PL; Peter A. Matos

(57) ABSTRACT

A ring structured to be worn on a digit of a wearer having a body including oppositely disposed open sides, inner and outer surfaces, extending between the opposite open sides. A plurality of surface segments extending along a length of the inner surface, wherein at least a majority thereof include an outer face. A plurality of grooves is formed in the inner surface and extend between and in communication with the open sides, wherein the plurality of grooves is disposed between and define the boundaries of adjacent ones of the surface segments. The outer faces have raised, substantially outwardly curved configurations along the lengths thereof and with the grooves are disposed and configured to facilitate fluid flow along the inner surface, between and through the open sides and between the inner surface of the ring and an outer surface of a digit of the wearer.

13 Claims, 5 Drawing Sheets

(56) References Cited

U.S. PATENT DOCUMENTS

| | | | |
|---|---|---|---|
| D68,642 | S | 11/1925 | Robbins |
| D68,644 | S | 11/1925 | Robbins |
| D68,931 | S | 12/1925 | Robbins |
| D74,909 | S | 4/1928 | White |
| D83,453 | S | 2/1931 | Krasnow |
| D85,234 | S | 9/1931 | Gross |
| D85,237 | S | 9/1931 | Gross |
| D85,505 | S | 11/1931 | Zell |
| 1,855,331 | A | 4/1932 | Bernier |
| D88,266 | S | 11/1932 | Stern |
| D92,694 | S | 7/1934 | Bayardi |
| D96,056 | S | 6/1935 | Sager |
| 2,009,390 | A | 7/1935 | Bayardi |
| 2,016,679 | A | 10/1935 | Mayer |
| D109,085 | S | 3/1938 | Soroka |
| 2,109,609 | A | 3/1938 | Aull |
| 2,146,426 | A | 2/1939 | Gittler |
| D116,337 | S | 8/1939 | Gaertner |
| D136,038 | S | 7/1943 | Lampl |
| D160,275 | S | 9/1950 | Rodriguez |
| 3,022,648 | A | 2/1962 | Thaler |
| D201,378 | S | 6/1965 | Katz |
| D203,551 | S | 1/1966 | Transfield |
| 3,360,959 | A | 1/1968 | Schechter et al. |
| 3,557,571 | A | 1/1971 | Santo |
| 3,643,467 | A | 2/1972 | Postel |
| 3,805,549 | A | 4/1974 | Nielsen |
| 4,086,786 | A | 5/1978 | Ritter |
| D248,286 | S | 6/1978 | Barr |
| D248,741 | S | 8/1978 | Barr |
| 4,170,118 | A | 10/1979 | Block |
| 4,218,894 | A | 8/1980 | Tropea |
| D264,060 | S | 4/1982 | Epstein |
| D277,171 | S | 1/1985 | Bulgari |
| D279,462 | S | 7/1985 | Weikel |
| 4,631,929 | A | 12/1986 | Hollingworth |
| D297,718 | S | 9/1988 | Cohen et al. |
| D298,422 | S | 11/1988 | Messa |
| 4,781,705 | A | 11/1988 | Shepard et al. |
| 4,793,156 | A | 12/1988 | Pence |
| D299,912 | S | 2/1989 | Goldman et al. |
| D301,121 | S | 5/1989 | Messa |
| D302,954 | S | 8/1989 | Goldman et al. |
| 4,970,878 | A | 11/1990 | Lee |
| D312,597 | S | 12/1990 | Bulgari |
| 5,129,851 | A | 7/1992 | Villanueva |
| 5,170,643 | A | 12/1992 | Porcell, Jr. |
| D337,741 | S | 7/1993 | Garfolo |
| 5,253,490 | A | 10/1993 | Doganay |
| 5,329,789 | A | 7/1994 | Mandelbaum |
| D360,376 | S | 7/1995 | Kaplan |
| D365,780 | S | 1/1996 | Kaplan |
| 5,520,016 | A | 5/1996 | Liu |
| 5,588,309 | A | 12/1996 | Choiffe |
| 5,588,310 | A | 12/1996 | Lai |
| 5,605,059 | A | 2/1997 | Woodward |
| 5,671,613 | A | 9/1997 | Hoover et al. |
| 5,792,175 | A | 8/1998 | Yoo |
| D400,470 | S | 11/1998 | Ambar |
| D418,081 | S | 12/1999 | Kaplan |
| 6,032,486 | A | 3/2000 | Uchin |
| D422,935 | S | 4/2000 | Chan |
| 6,116,053 | A | 9/2000 | Siebenberg |
| D434,693 | S | 12/2000 | Kaplan |
| 6,171,606 | B1 | 1/2001 | Lyon |
| D438,813 | S | 3/2001 | Yellen |
| D439,189 | S | 3/2001 | Gueit |
| D445,058 | S | 7/2001 | Kaplan |
| D453,908 | S | 2/2002 | Kaplan |
| D454,090 | S | 3/2002 | Kaplan |
| 6,354,106 | B1 | 3/2002 | Kataw |
| D459,674 | S | 7/2002 | Razza |
| 6,427,486 | B1 | 8/2002 | Yellen |
| 6,701,618 | B2 | 3/2004 | Gefen |
| D491,092 | S | 6/2004 | Kurdi |
| 6,857,289 | B1 | 2/2005 | Cheng |
| D505,636 | S | 5/2005 | Bisceglie |
| D522,902 | S | 6/2006 | Kaplan |
| D541,693 | S | 5/2007 | Skuza et al. |
| 7,296,439 | B2 | 11/2007 | Tanory, Jr. |
| 7,350,377 | B2 | 4/2008 | Kaplan |
| 7,430,879 | B2 | 10/2008 | Cazjka et al. |
| 7,631,517 | B2 | 12/2009 | Kaplan |
| D639,692 | S | 6/2011 | Papadimitriou |
| D656,615 | S | 3/2012 | Tzeng |
| 8,453,709 | B1 | 6/2013 | Williams |
| D695,643 | S | 12/2013 | Wolff |
| D712,298 | S | 9/2014 | Taylor-Cattapan |
| D717,686 | S | 11/2014 | Aoki |
| D718,171 | S | 11/2014 | Fakesch |
| D718,173 | S | 11/2014 | Sandberg |
| 9,165,318 | B1 | 10/2015 | Pauley et al. |
| 9,226,552 | B1 | 1/2016 | Makhoulian et al. |
| D780,614 | S | 3/2017 | Kaplan |
| D789,233 | S | 6/2017 | Baker et al. |
| D789,234 | S | 6/2017 | Baker et al. |
| D815,975 | S | 4/2018 | Silvestri |
| D834,444 | S | 11/2018 | Dousset |
| D863,907 | S * | 10/2019 | Little ..... D8/57 |
| D893,344 | S | 8/2020 | Jain et al. |
| 10,925,356 | B2 | 2/2021 | Pellegrino |
| 11,037,318 | B1 | 6/2021 | Kaplan |
| D933,515 | S | 10/2021 | Wu |
| D945,917 | S | 3/2022 | Kaplan |
| D1,067,103 | S | 3/2025 | Kaplan |
| D1,067,105 | S | 3/2025 | Kaplan |
| D1,067,805 | S | 3/2025 | Kaplan |
| D1,068,539 | S | 4/2025 | Kaplan |
| 2002/0127128 | A1 | 9/2002 | Har-Shai |
| 2005/0268653 | A1 | 12/2005 | Kaplan |
| 2006/0277946 | A1 | 12/2006 | Lu |
| 2007/0137250 | A1 | 6/2007 | Kohl |
| 2007/0180860 | A1 | 8/2007 | Hirata et al. |
| 2008/0148774 | A1 | 6/2008 | Thurber |
| 2011/0289966 | A1 | 12/2011 | Ahrenholtz et al. |
| 2013/0036767 | A1 | 2/2013 | Mehta |
| 2013/0091895 | A1 | 4/2013 | Hwang |
| 2016/0246326 | A1 | 8/2016 | von Badinski et al. |
| 2019/0045892 | A1 | 2/2019 | Guzy |
| 2019/0116946 | A1 * | 4/2019 | Jones ..... A44C 9/00 |
| 2019/0298013 | A1 | 10/2019 | Setton et al. |

FOREIGN PATENT DOCUMENTS

| | | |
|---|---|---|
| JP | 3096467 | 7/2002 |
| WO | WO2005120279 | 12/2005 |

OTHER PUBLICATIONS

Etsy, Sterling Silver Polished Plain Round Open Tube Pendant Bail , pp. 1-13, https://www.etsy.com/listing/815274172/sterling-silver-polished-plain-round?ga-ordermost_relevant&ga_search_type=all&ga_view_type=gallery&ga%E2%80%A6, Jan. 1, 2021.

Merit Diamond Corporation, [online] http://www.meritdiamond.com/mfit/., Feb. 4, 2016.

[online] http://s-media-cache-ak0.pinimg.com/736x/44/eb/f7/44ebf743ee7338a8caf3daa3734a369b.jpg., Feb. 4, 2016.

* cited by examiner

RING WITH COMFORT FIT INTERIOR

BACKGROUND OF THE INVENTION

Field of the Invention

A ring structured to be worn on a digit of a wearer specifically including, but not limited to, a finger of the wearer. Structural and operative features of the ring include an inner surface structured to facilitate comfort, while being worn, and facilitate ease of removal when desired.

DESCRIPTION OF THE RELATED ART

Many types of rings, especially wedding bands and/or engagement rings are traditionally worn by the wearer for extended periods of time. Furthermore, especially significant jewelry pieces are traditionally worn for many years. As a result of this prolonged wearing, the area of the wearer's skin beneath the ring can often have limited circulation and airflow between the inner surface of the ring and the outer surface of the wearer's digit. This can naturally lead to some discomfort over extended periods of time. Further, the potential for discomfort associated with an extended period of wear time can be especially troublesome when the wearer experiences weight gain. This in turn may result in a snug or tighter fitting of the ring. As a result, when such circumstances arise, there can be an uncomfortable amount of pressure being applied to the finger or other digit of the wearer when the ring is being worn. Also, the circumstances relating to the removal of the ring may also present difficulties due at least in part to the ring "digging" into the wearer's skin and/or a resulting formation of an indentation on or within the skin of the wearer.

Presently, available ring structures having interior surface configurations and/or structures directed to facilitate comfort include a plurality of regularly spaced, perpendicularly oriented grooves. As such, the plurality of grooves is disposed along some portions and/or an entire interior ring surface. While such an interior surface configuration does provide some increased airflow and breathability, the amount of airflow and pressure relief provided by such a perpendicular grooved configuration may be limited. However, at least to some extent, this type of configuration may be limited or restricted by the width or other structural characteristics of the ring. In such circumstances a relatively narrow ring may offer minimal relief even with the existence of a configuration and/or structure of the type set forth above. In addition, other known and/or commercially available ring structures intended to provide additional comfort are susceptible to rotation of the ring while on the wearer's finger. Accordingly, while a secure fit of a ring is often desirable to prevent inadvertent loss, a preferred interior surface structure would result in the ring not being too tightly secured to subject the wearer to discomfort.

Therefore, there is a recognized need in the area of the structure, configuration and overall design of jewelry rings having a more comfortable and wearer-friendly interior surface that not only improves the "breathability" of the ring when worn, but also reduces the amount of pressure the ring applies to the wearer's finger or other digit. Further, a proposed and improved inner surface structure of a ring should facilitate easy removal, even in circumstances involving a prolonged use and or enlargement of the finger of the wearer. Furthermore, it would be especially beneficial to provide a comfort ring structure and/or configuration, wherein the width and other physical characteristics of the ring do not limit airflow and pressure relief. Moreover, an improved ring structure could include an area between the inner surface of the ring and the outer surface of a wearer's digit which is more easily accessible by a lubricant or other fluid in order to aid in the wearing and/or removal of the ring. Along these lines, such a configuration will also preferably facilitate the removal of the ring, especially if the dimensions of the digit on which an improved ring structure is worn have changed over time.

SUMMARY OF THE INVENTION

The present invention is directed to a ring structured to be worn on a finger or other digit of an individual, which may or may not have an integral, one-piece construction. Further, the ring includes a body having an inner surface and an outer surface, wherein both the inner and outer surfaces extend between oppositely disposed open sides of the body. As explained in greater detail hereinafter, one or more preferred embodiments of the present invention include the structuring, configuring and dimensioning of the inner surface in a manner which facilitates safe and reliable retention of the ring on the digit of the wearer, comfort to a wearer when worn and also ease in removal of the ring, when desired.

In more specific terms, the ring includes a body including oppositely disposed open sides dimensioned and configured to allow passage of a digit of the wearer therethrough in somewhat conventional fashion. Further, the body includes an inner surface and an outer surface extending between the open sides. A plurality of grooves is formed in the inner surface and also extend between and in communication with the open sides of the body and in some embodiments in direct communication with the peripheries of the oppositely disposed open sides.

Each of the plurality of grooves are disposed between and in contiguous or immediately adjacent relation to adjacent ones of the plurality of surface segments. As such, each or at least the majority of the surface segments are disposed between spaced, but next adjacent ones of the plurality of grooves. As explained in greater detail hereinafter, the cooperative disposition, configuration and overall structure of the plurality of surface segments and the plurality of grooves are such as to facilitate comfort to the wearer. Such a preferred comfortable fit or wearing is due in part, but not limited to, the facilitation of fluid flow along the inner surface of the body of the ring and between the inner surface of the body and the outer surface of the digit on which the ring is disposed. In addition, such a comfort fit may also be at least partially the result of a somewhat lesser than normal pressure exerted on the outer surface of the wearer's digit due, at least in part, to the configuration of an outer face of all or at least a majority of the surface segments.

For purposes of clarity, the terminology used herein to describe the structural and dimensional characteristics of the various preferred embodiments of the ring may include "inner circumference", and/or "circumferential length". In more specific terms, as used herein the length of the inner surface and/or the length of the collective, continuously disposed surface segments is defined by the "inner circumference" and/or "circumferential length" of the body. As such, it is to be noted that the term "inner circumference" and/or its equivalent substantially defines a dimension or structure which surrounds and substantially defines the outer boundaries of the open interior and/or center of the body. In cooperation therewith, the "length" of the surface segments and outer faces of the surface segments refers to the dimensional characteristics thereof that extends along the width of the ring, between the open sides and in some embodiments in communication with peripheries of the open sides. Further, the length of the surface segments and outer faces thereof are disposed in transverse relation to the "length" or inner circumference of the inner surface and or body.

It is to be further noted that the shape of the various embodiments of the ring of the present invention, specifically including the body, inner surface, surface segments and outer faces, when considered collectively, may not have precisely circular configurations. As such, the indicated structures of some embodiments may be purposefully shaped to be other than circular. Accordingly, in order to avoid confusion, the terms "inner circumference", "circumferential length" and the equivalents thereof are used to describe the dimensional, structural and operative characteristics of the ring, whether or not circular.

Further, with regard to the structural features of at least one preferred embodiment of the body of the ring, each or at least a majority of the surface segments include an outer face having a raised, substantially outwardly curved configuration extending along the length of the respective outer face and surface segments and between the opposite open sides. In at least one embodiment, the raised, substantially outwardly curved configuration extends between and terminates contiguous to or in direct communication with each periphery of the opposite open sides. Such determinations of the ends of the outer faces may further aid in the establishment of fluid flow such as, but not limited to, air passing through the open sides and along the inner surface. As will be further demonstrated, the disposition of the ends of the outer faces adjacent or in communication with the open sides, and the cooperative disposition of the outer faces with the plurality of grooves further facilitates the aforementioned fluid flow along the width of the body and the length of the plurality of surface segments.

The aforementioned "raised" configuration of each or at least a majority of the outer faces may be accurately described as including a midportion extending outwardly from the inner surface a greater distance than opposite ends of the same outer face. In cooperation therewith, each of at least a majority of the plurality of grooves include a midsegment disposed substantially adjacent the midportion of the outer faces of adjacently disposed ones of the surface segments. Accordingly, the midportion extends inwardly towards the center of the opening of the body and outwardly from the remainder of the inner surface, a greater distance than the opposite ends of a given outer face of a given surface segment.

Such a raised midportion of the surface segments may further be disposed and structured to exert a sufficient pressure on the outer surface of the digit of a wearer so as to safely maintain the ring in place, on the wearer's digit. However, because the raised midportions of the outer faces are raised above the opposite ends of a given outer face, a somewhat lesser retaining pressure is exerted on the wearer's digit, since the entire lengths of the outer faces are not normally in continuous engagement with the outer surface of the wearer's digit. This not only enhances the comfort to the wearer but also facilitates removal of the ring from the digit when required. Moreover, the aforementioned "facilitated fluid flow" may include not only the passage of air through the central openings of the ring but also the administration of some type of lubricant which, when applied, will pass over at least a portion of the length of the outer face, including the raised midportion, wherein removal of the ring is facilitated.

It is of course recognized that all of the raised midportions of the raised, outer substantially curved configuration of outer faces may not concurrently engage the outer surface of the wearer's digit. However, in at least one embodiment the outer faces having the raised, substantially curved configuration along their respective lengths extend continuously along the entirety, or at least the majority of the length or inner circumference of the inner surface. Therefore, a sufficient number of raised midportions of the outer faces will be in contact with and exert enough pressure on the outer surface of the digit to prevent inadvertent removal of the body of the ring.

As indicated, the intended comfort fit of the body of the ring is due, at least in part, to the cooperative disposition, structuring, dimensioning and configuring of the surface segments, specifically including the outer faces thereof, and the plurality of grooves. Therefore, additional structural features of each or at least a majority of the plurality of grooves include an elongated curved configuration wherein opposite ends thereof are disposed in direct communication with the open sides and more specifically, in at least one embodiment, in direct communication with the peripheries of the opposite sides. Further, each or at least a majority of the plurality of curved grooves preferably comprise a common shape or configuration. In at least one embodiment, the plurality of grooves extends continuously along the length or inner circumference of the inner surface and or ring body in transverse relation thereto.

In that each or at least a majority of the plurality of surface segments are bounded or bordered by spaced apart, yet next adjacent ones of the plurality of grooves, the substantially common shape of such spaced apart grooves define the different, opposite longitudinal sides or borders of an intermediate surface segment and respective outer surface, as being substantially concave and substantially convex along the length of the longitudinal sides of the intermediate ones of the surface segments. Further, such opposite concave and convex sides of a given surface segment preferably extend long the entirety of the length of the respective longitudinal sides. Also, when spaced yet adjacent grooves extend along opposite sides of a given intermediate surface segment and outer face, the opposite ends thereof are disposed in direct communication with the peripheries of the oppositely disposed open sides. As a result, enhanced fluid communication and fluid flow within the open interior of the body and along the inner surface may be further facilitated by such direct communication.

In addition, at least one preferred embodiment of the ring of the present invention includes the grooves having an average predetermined depth. While such depth may vary dependent, at least in part on the overall size of the ring body, in one preferred embodiment the average depth along at least a majority of the length of each or at least a majority of the plurality of grooves is 0.25 inches. Further, it is recognized that such a predetermined depth may not be common to the entire length of the plurality of grooves. Instead, the opposite ends of a given commonly curved groove may have a lesser depth than 0.25 inches, where in a midsegment 21 of the curved groove may have or be closer to the preferred predetermined depth of 0.25 inches.

Therefore, the structural and operative features of one or more embodiments of the ring of the present invention overcome recognized problems and disadvantages of known or prior art ring structure by providing a ring which may be comfortably placed and maintained on the digit of a wearer in a manner which also facilitates the removal thereof when such is desired.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
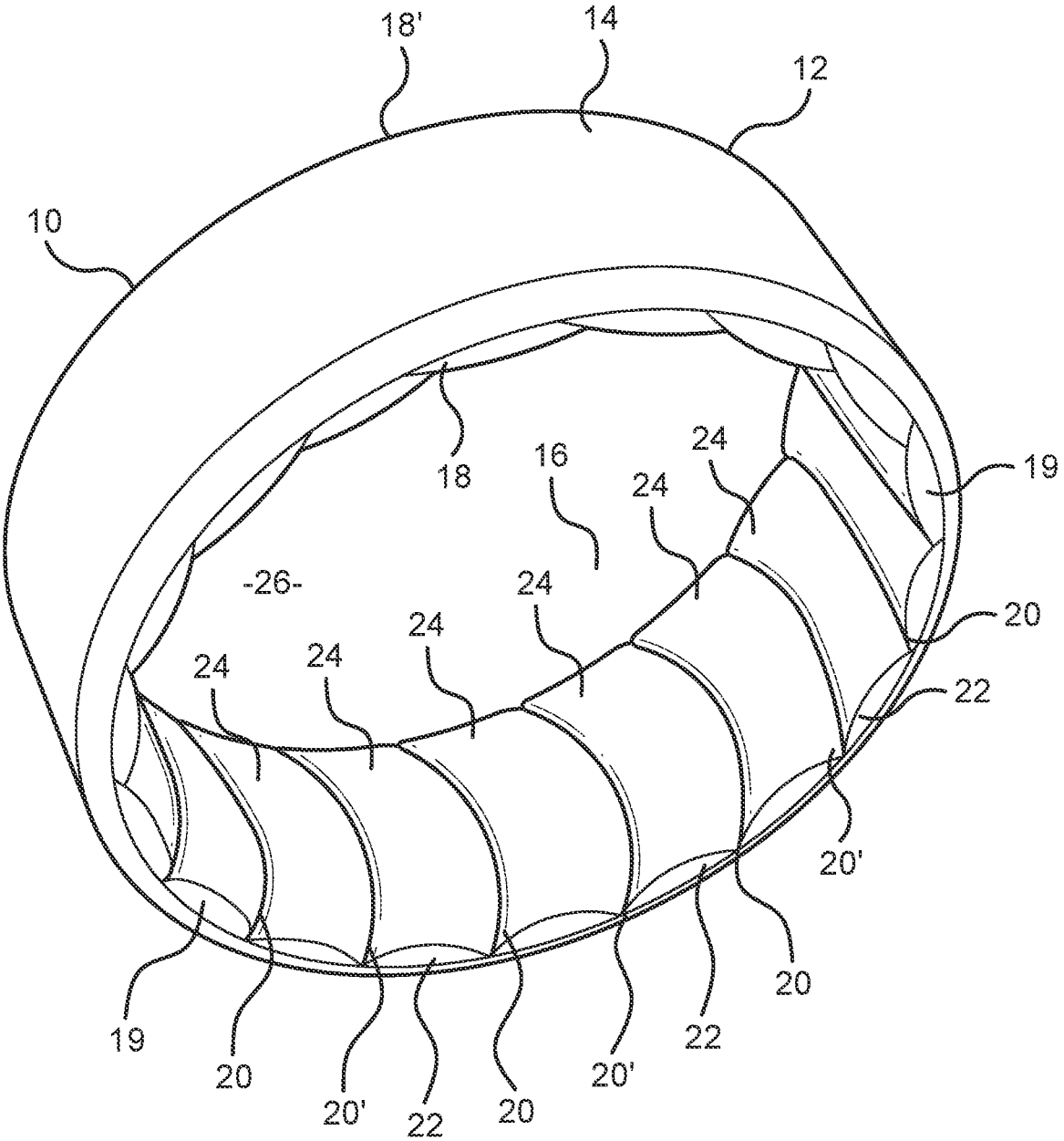
FIGS. 1 and 2 are perspective interior and exterior views of the ring of the present invention.
Figure 2:
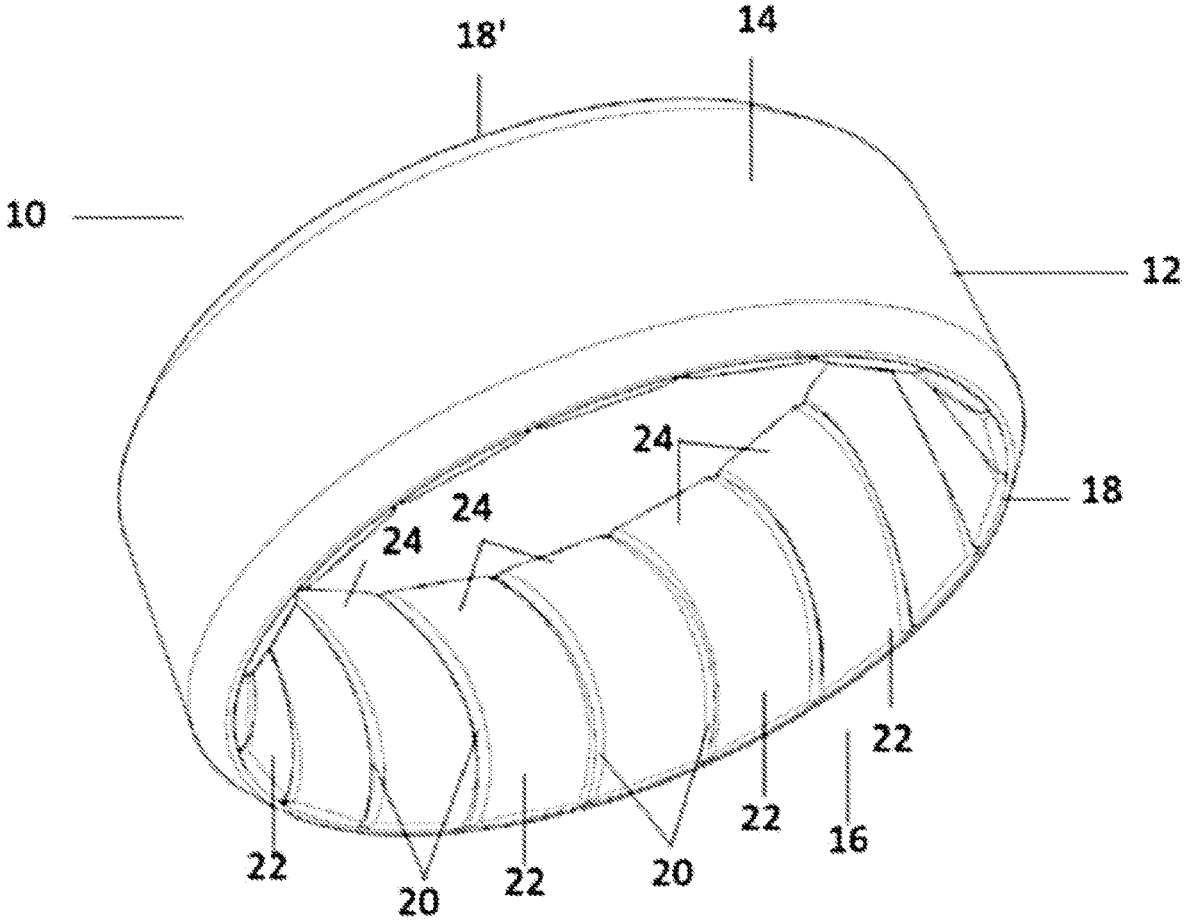

The invention now will be described more fully hereinafter with reference to the accompanying drawings in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is directed to a ring 10 structured to be worn on a finger or other digit of an individual (not shown for purposes of clarity), which may or may not have an integral, one-piece construction. Further, the ring 10 includes a body 12 having an outer surface 14 and an inner surface 16, wherein both the inner and outer surfaces extend between oppositely disposed open sides 18 and 18' of the body 12. As explained in greater detail hereinafter, one or more preferred embodiments of the present invention include the structuring, configuring and dimensioning of the inner surface 16 and a plurality of surface segments 22, defining and/or formed on the inner surface 16, in a manner which facilitates safe and reliable retention of the ring 10 on the digit of the wearer, comfort to a wearer when worn and also ease in removal of the ring 10, when desired.

Figure 4:
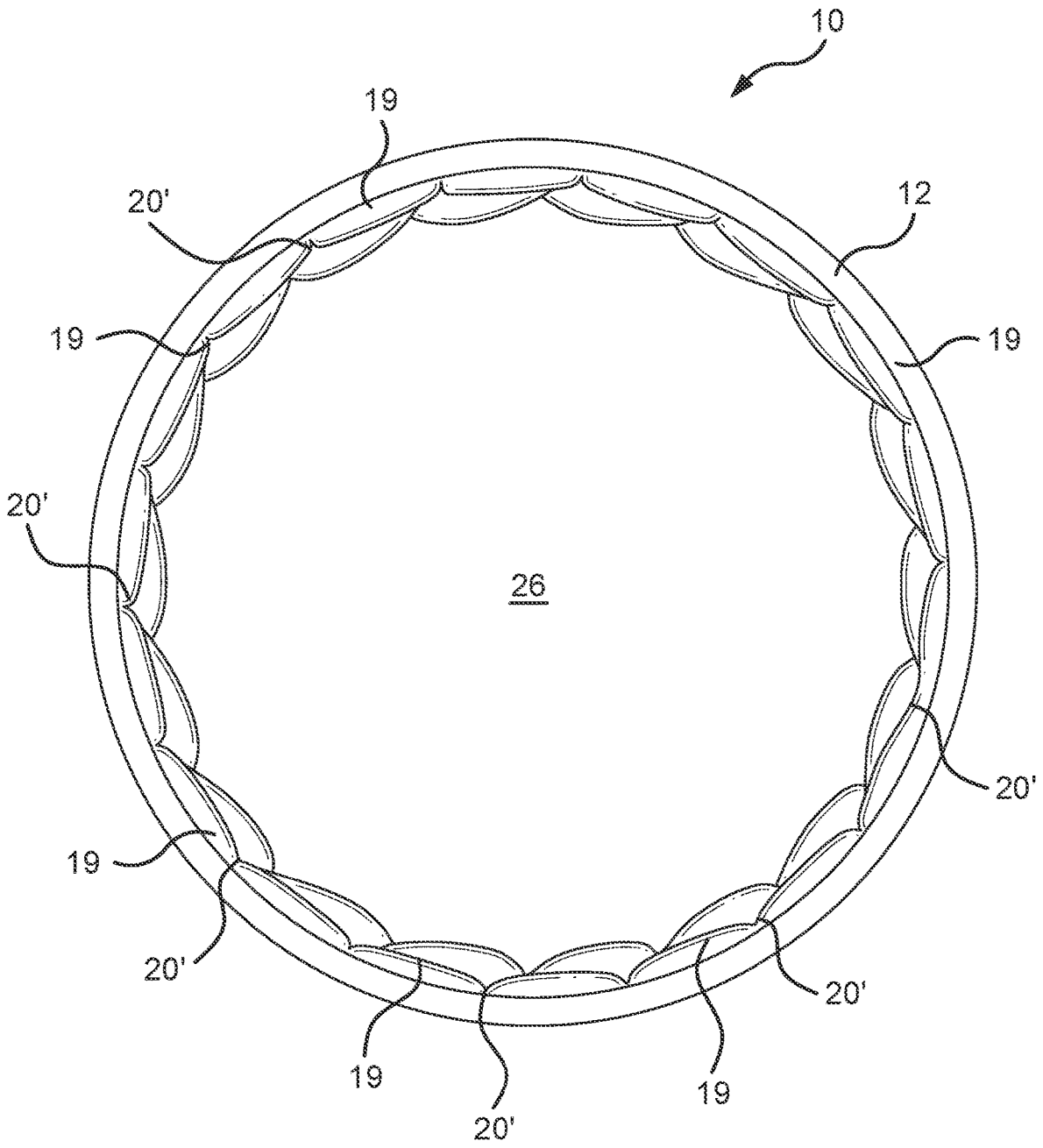
FIG. 4 is a side view in elevation of the embodiment of FIGS. 1-3.

In more specific terms, the ring 10 includes the body 12 having the oppositely disposed open sides 18 and 18' dimensioned and configured to allow passage of a digit of the wearer therethrough in somewhat conventional fashion. Further, the body 12 includes the inner surface 16 and an outer surface 14 extending between the open sides 18 and 18'. A plurality of grooves 20 are formed in the inner surface 16 and also extend between and in communication with the open sides 18 and 18' of the body 12 and in some embodiments, such as represented in at least FIG. 4, opposite ends 20' of the grooves 20 are disposed in direct communication with the peripheries 19 of the oppositely disposed open sides 18 and 18'.

Each of the plurality of grooves 20 is disposed between and in contiguous or immediately adjacent relation to adjacent ones of the plurality of surface segments 22. As such, each or at least the majority of the surface segments 22 are disposed between spaced, but next adjacent, ones of the plurality of grooves 20. As explained in greater detail hereinafter, the cooperative disposition, configuration and overall structure of the plurality of surface segments 22 and the plurality of grooves 20 are such as to facilitate comfort to the wearer. Such a preferred comfortable fit is due at least in part, but not limited to, the facilitation of fluid flow passing along the inner surface 16 of the body 12 and between the inner surface 16 and the outer surface of the digit on which the ring 10 is worn. In addition, such a comfort fit may also be at least partially the result of a somewhat lesser than normal pressure exerted on the outer surface of the wearer's digit due, at least in part, to the configuration 30 of an outer face 24 extending along the length of all or at least a majority of the surface segments 22 defining the inner surface 16.

For purposes of clarity, the terminology used herein to describe the structural and dimensional characteristics of the various preferred embodiments of the ring 10 and/or body 12 may include "inner circumference", and/or "circumferential length". In more specific terms, as used herein the length of the inner surface 16 and/or the collective length of the continuously disposed surface segments 22 is defined by the "inner circumference" and/or "circumferential length" of the body. As such, it is to be noted that the term "inner circumference" and/or its equivalent substantially defines a dimension or structure which surrounds and substantially defines the outer boundaries of the open interior 26 and/or center of the body 12. In cooperation therewith, the "length" of the individual surface segments 22 and the respective outer faces 24 refers to the dimensional characteristics thereof that extends along the width of the ring 10, between the open sides 18 and 18' and in some embodiments in communication with peripheries 19 of each of the open sides 18 and 18'. Further, the length of the individual surface segments 22 and outer faces 24 thereof are disposed in transverse relation to the "length" or inner circumference of the inner surface 16 and the body 12.

It is to be further noted that the shape of the various embodiments of the ring 10 of the present invention, specifically including the body 12, outer and inner surfaces 14 and 16, surface segments 22 and outer faces 24, when considered collectively, may not have precisely circular configurations as represented throughout the Figures. As such, the indicated structures of some embodiments of the ring 10 may be purposefully shaped to be other than circular. Accordingly, in order to avoid confusion, the terms "inner circumference", "circumferential length" and the equivalents thereof are used to describe the dimensional, structural and operative characteristics of the ring 10, whether or not structured to include a true circular configuration.

Figure 5A:
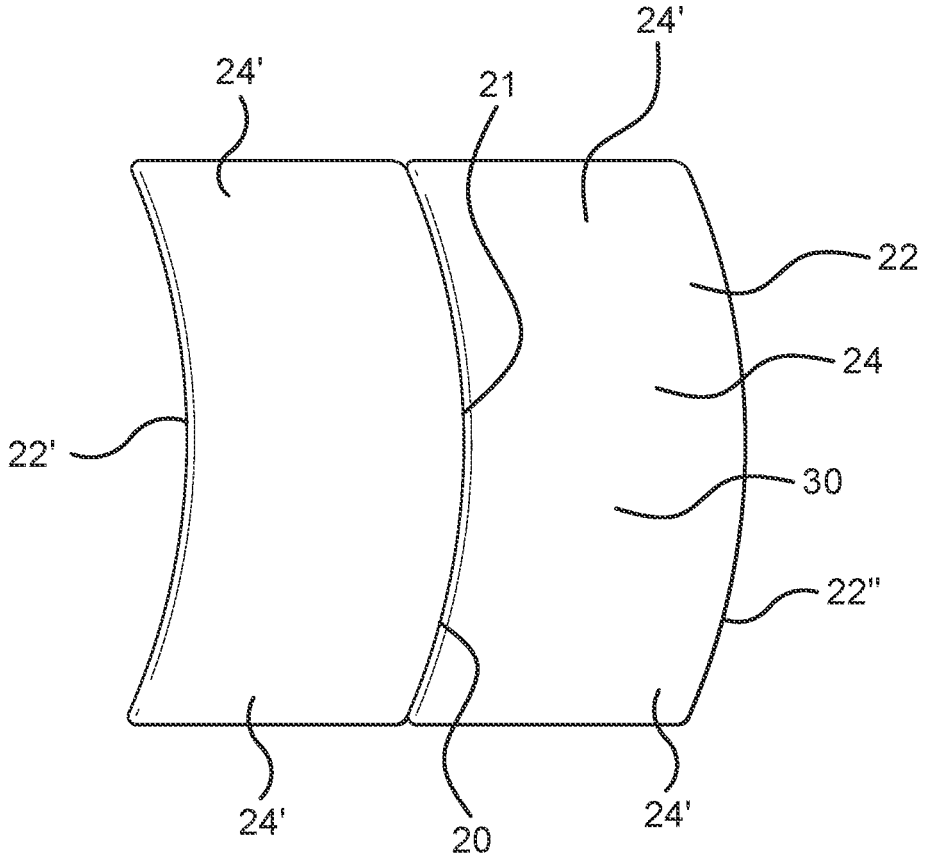
FIG. 5A is a detailed view of outer faces of contiguous surface segments of the outer surface of the embodiment of FIGS. 1-4.
Figure 5B:
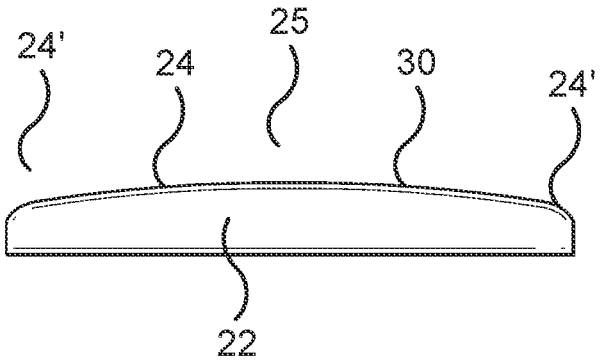
FIG. 5B is a longitudinal side view of the embodiment of FIG. 5A.

Further, with regard to the structural features of at least one preferred embodiment of body 12, each or at least a majority of the surface segments 22 include the outer face 24 having a raised, substantially outwardly curved configuration 30 extending along the length of the respective outer faces 24 and surface segments 22 and between the opposite open sides 18 and 18', as generally represented in FIG. 5B. In at least one embodiment, such as represented in at least FIGS. 4, the raised, substantially outwardly curved configuration 30 of the outer face 24 extends between and terminates contiguous to or in direct communication with each periphery 19 of the opposite open sides 18 and 18'. Such disposition of the ends 24' of the outer faces 24 may further aid in the establishment of fluid flow such as, but not limited to, air passing through the open sides 18 and 18' and along the inner surface 16. As will be further demonstrated, the disposition of the ends 24' of the outer faces 24 adjacent or in communication with the open sides 18 and 18', and the cooperative disposition of the outer faces 24 with the plurality of grooves 20 further facilitates the aforementioned fluid flow along the width of the body 12 and the length of the plurality of surface segments 22.

As also represented in FIGS. 5A and 5B, the aforementioned "raised" configuration of each or at least a majority of the outer faces 24 may be accurately described as including a raised midportion 25 extending outwardly from the inner surface 16 a greater distance than opposite ends 24' of the same outer face 24. In cooperation therewith, each of at least a majority of the plurality of grooves 20 include a midsegment 21 disposed substantially adjacent the midportion 25 of the outer faces 24 of adjacently disposed ones of the surface segments 22. Accordingly, the midportion 25 extends inwardly towards the center of the opening 26 of the body and outwardly form the remainder of the inner surface 16, a greater distance than the opposite ends 24' of a given outer face 24 of a given surface segment 22.

Such a raised midportion 25 may further be disposed and extend outwardly from the inner surface 16 a sufficient distance to exert a sufficient pressure on the outer surface of the digit of a wearer, to safely maintain the ring 10 in place, on the wearer's digit. However, because the raised midportion 25 of the outer faces 24 is raised above the opposite ends 24' of a given outer surface 24, a somewhat lesser retaining pressure is exerted on the wearer's digit, since the entire length of the outer faces 24 are not normally in continuous engagement with the outer surface of the wearer's digit. This not only enhances the comfort to the wearer but also facilitates removal of the ring 10 from the digit when required. Moreover, the aforementioned "facilitated fluid flow" may include not only the passage of air through the central openings 18 and 18' of the ring 10, but also the administration of some type of lubricant which, when applied, will pass over at least a portion of the length of the outer face 24, including the raised midportion 25, wherein removal of the ring 10 is facilitated.

It is of course recognized that all of the raised midportions 25 of the raised, outer substantially curved configuration 30 of outer faces 24 may not concurrently engage the outer surface of the wearer's digit. However, in at least one embodiment, the outer faces 24 having the raised, substantially curved configuration 30 along their respective lengths collectively extend continuously along the entirety, or at least the majority of the length or inner circumference of the inner surface 16. Therefore, a sufficient number of raised midportions 25 of the outer faces 24 will always be in contact with and exert enough pressure on the outer surface of the digit to prevent inadvertent removal of the body 12 of the ring 10.

As indicated, the intended comfort fit of the body of the ring 10 is due, at least in part, to the cooperative disposition, structuring, dimensioning and configuring of the surface segments 22, specifically including the outer faces 24 thereof, and the plurality of grooves 20. Therefore, additional structural features of each or at least a majority of the plurality of grooves 20 include an elongated curved configuration, wherein opposite ends 20' thereof are disposed in direct communication with the open sides 18 and 18' and more specifically, in at least one embodiment, in direct communication with the peripheries 19 of the opposite open sides 18 and 18'. Further, each or at least a majority of the plurality of curved grooves 20 preferably comprise a common or substantially equivalent shape or configuration. In at least one embodiment, the plurality of grooves extends continuously along the length or inner circumference of the inner surface 16 and or ring body and in transverse relation thereto.

Figure 3:
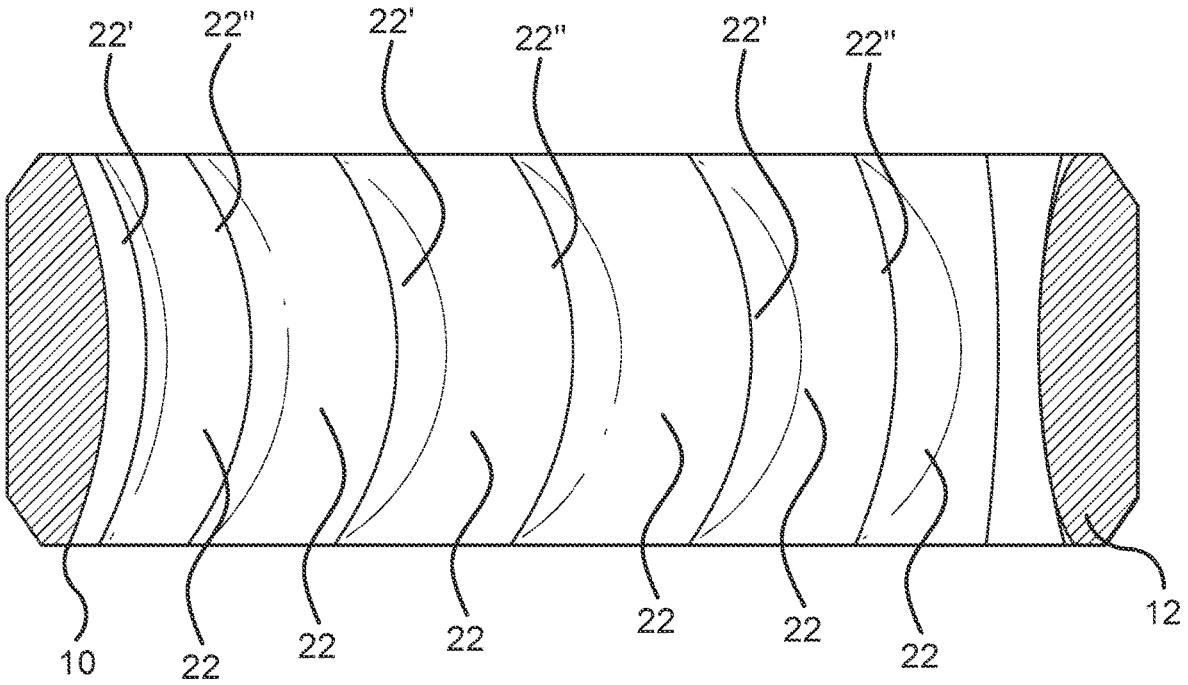
FIG. 3 is an interior side view in section of the embodiment of FIGS. 1 and 2.

With primary reference to at least FIG. 3, each or at least a majority of the plurality of surface segments 22 are bounded or bordered on opposite sides by spaced apart, yet next adjacent ones of the plurality of grooves 20, the common or substantially equivalent shape of such spaced apart grooves 20 define the different, opposite longitudinal sides or borders of an intermediate surface segment 20, as being substantially concave, as at 22' and substantially convex as at 22" along the length of the longitudinal sides of the intermediate ones of the surface segments 22. Further, such opposite concave and convex sides 22' and 22" respectively, of a given surface segment 22 preferably extend long the entirety of the length of the longitudinal sides of the respective surface segments 22. Also, when spaced and adjacent grooves 22 extend along opposite longitudinal sides of a given intermediate surface segment 22 and outer face 24, the opposite ends 20' thereof are disposed in direct communication with the peripheries 19 of the oppositely disposed open sides 18 and 18' as represented in at least FIG. 4. As a result, enhanced fluid communication and fluid flow within the open interior 26 of the body 12 and along the inner surface 16 may be further facilitated by such direct communication.

In addition, at least one preferred embodiment of the ring 10 of the present invention includes the grooves 20 having an average predetermined depth. While such depth may vary dependent, at least in part on the overall size of the ring body, in one preferred embodiment the average depth along at least a majority of the length such as, but not limited to, the raised midportion 25 is 0.25 inches. Further, it is recognized that such a predetermined depth may not be common to the entire length of the plurality of grooves 20. Instead, the opposite ends 20' of a given commonly curved groove 20 may have a lesser depth than 0.25 inches, wherein a midsegment 21 of the curved groove 20 may have or be closer to the preferred predetermined depth of 0.25 inches.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A ring structured to be worn on a digit of a wearer, said ring comprising:

a body including oppositely disposed open sides and an inner surface and an outer surface extending between said open sides, a plurality of surface segments collectively extending along an inner circumference of said body, a plurality of grooves formed in said inner surface and extending between and in communication with said open sides, each of said plurality of grooves disposed between and in contiguous relation to adjacent ones of said plurality of surface segments, said plurality of grooves configured to facilitate fluid flow along said inner surface, between and through said open sides, at least a majority of said plurality of surface segments including an outer face, each of said outer faces have a substantially outwardly curved configuration extending along a length thereof, each of said outer faces further including a midportion extending outwardly from opposite end portions of said outer face, and each of said plurality of grooves including a midsegment disposed adjacent said midportion of adjacently disposed ones of said plurality of surface segments, each of said midsegments having a depth greater than opposite ends of said groove.

2. The ring as recited in claim 1 wherein each of said outer faces include a raised midportion, said raised midportions extending outwardly from said plurality of grooves.

3. The ring is recited in claim 1 wherein said substantially outwardly curved configuration of said lengths of said outer faces extends between and terminates contiguous to a periphery of each of said open sides.

4. The ring is recited in claim 3 wherein said lengths of said outer faces extend transversely to said inner circumference of said body.

5. The ring as recited in claim 1 wherein said depth of said plurality of grooves is about 0.25 inch, along at least a portion of a length thereof.

6. The ring as recited in claim 1 wherein at least a majority of said plurality of grooves include a curved configuration extending along a length thereof, between said open sides.

7. The ring as recited in claim 6 wherein said curved configuration of said at least majority of said plurality of grooves include a substantially common shape.

8. The ring as recited in claim 7 wherein said curved configuration of said at least majority of said plurality of grooves define different, opposite longitudinal sides of adjacent ones of said plurality of surface segments as having a substantially concave configuration and a substantially convex configuration.

9. The ring as recited in claim 8 wherein said concave and convex configurations extend along an entirety of a length of said adjacent ones of said plurality of surface segments, between and in communication with a periphery of each of said open sides.

10. A ring structured to be worn on a digit of a wearer, said ring comprising a body including oppositely disposed open sides and an inner surface and an outer surface extending between said open sides, a plurality of surface segments collectively extending along an inner circumference of said body, each of said plurality of said surface segments including an outer face, a plurality of grooves formed in said inner surface and the extending between and in communication with a periphery of each of said open sides, each of said plurality of grooves disposed between and in contiguous relation to adjacent ones of said plurality of surface segments, said plurality of grooves including a curved configuration of a substantially common shape, said plurality of surface segments and said outer faces each including a length extending transversely to said inner circumference of said body and between said open sides, at least a majority of said outer faces have a substantially outwardly curved configuration extending along said length thereof, said plurality of grooves and said plurality of surface segments cooperatively disposed and configured to facilitate fluid flow, between and through said open sides, and between said plurality of surface segments and an outer surface of a digit of the wearer, and said curved configuration of said plurality of grooves defining different, opposite longitudinal sides of adjacent ones of said plurality of surface segments as having a substantially concave configuration and a substantially convex configuration.

11. The ring as recited in claim 10 wherein said substantially outwardly curved configuration of said outer faces extends between and terminates contiguous to said periphery of each of said open sides.

12. The ring as recited in claim 10 wherein each of said outer faces further includes a midportion extending outwardly from opposite ends of said outer face.

13. The ring as recited in claim 10 wherein said concave and convex configurations extend along an entirety of a length of said surface segment, between and in communication with said periphery of each of said open sides.

* * * * *